US005337519A

United States Patent [19]

Bergesio

[11] Patent Number: 5,337,519

[45] Date of Patent: Aug. 16, 1994

[54] VEHICLE WINDOW REGULATING DEVICE

[75] Inventor: Giuseppe Bergesio, Bra, Italy

[73] Assignee: Roltra Morse S.p.A., Rivoli, Israel

[21] Appl. No.: 46,087

[22] Filed: Apr. 12, 1993

[30] Foreign Application Priority Data

Apr. 17, 1992 [IT] Italy ..... TO92 A 000349

[51] Int. Cl.[5] ..... E05F 11/44

[52] U.S. Cl. ..... 49/351; 49/349

[58] Field of Search ..... 49/351, 348, 349, 350

[56] References Cited

U.S. PATENT DOCUMENTS 3,020,040 2/1962 King et al. ..... 49/351 X
4,106,353 8/1978 Kondo .
4,219,968 9/1980 Sakai et al. ..... 49/350 X
4,777,766 10/1988 Johnson et al. .
4,825,594 5/1989 Escaravage ..... 49/351
5,195,211 3/1993 Krajenke ..... 49/351 X

FOREIGN PATENT DOCUMENTS 466033 1/1992 European Pat. Off. ..... 49/351

*Primary Examiner*—Philip C. Kannan
*Attorney, Agent, or Firm*—Wolf, Greenfield & Sacks

[57] ABSTRACT

A window regulating device wherein a transmission arm presents a first end hinged to a curved window of a vehicle door, and a second end connected to a slide fitted in sliding manner to a slideway having a skew axis in relation to a generating line of the window; the transmission arm being controlled by an actuating arm having one end hinged to the slideway and the opposite end connected by a spherical joint to a mid portion of the transmission arm.

9 Claims, 3 Drawing Sheets

VEHICLE WINDOW REGULATING DEVICE

BACKGROUND OF THE INVENTION

The present invention relates to a vehicle window regulating device.

Anyone observing recent developments in vehicle body design cannot fail to note a marked tendency towards the production of vehicle bodies with an increasingly semicylindrical outer surface. As a result, the vehicle doors also present a arcuate shape, extending about a substantially horizontal longitudinal axis of the vehicle, and are fitted with arcuate sliding windows designed to slide in relation to the door along, not a straight path, but a substantially circular path perpendicular to the longitudinal axis of the vehicle.

The sliding windows of motor vehicles are operated using so-called "compass" type window regulating devices featuring a lever mechanism normally comprising a transmission arm having one end hinged to the bottom edge of the window, which is fitted to the door so as to slide, in relation to the same, along a substantially straight vertical path. At the end opposite that connected to the window, the transmission arm is hinged to a slide running along a slideway integral with the door, substantially parallel to the window, and substantially perpendicular to the path along which the window slides.

The above lever mechanism also comprises an actuating arm having a first end hinged to the slideway, and a second end hinged to the mid point of the transmission arm.

Though extremely efficient and silent-operating, known compass type window regulating devices of the aforementioned type fail to provide for guiding the sliding window along a curved path and, for this reason, have gradually been replaced by other equally efficient but noisier devices normally comprising a curved slideway fitted with a slide in turn fitted to the window and operated by flexible actuating members.

SUMMARY OF THE INVENTION

It is an object of the present invention to provide a lever-operated vehicle door window regulating device designed to guide the window along a curved path and which, at the same time, is straightforward and cheap to produce, and provides for a high degree of reliability.

According to the present invention, there is provided a vehicle window regulating device comprising a slideway extending along a first axis and designed for fitment integral with a respective door; slide means fitted in sliding manner to the slideway, so as to travel along said first axis; a transmission arm; first connecting means for connecting a first end of the transmission arm to a curved window mounted so as to slide, in relation to the door, along a substantially circular path substantially perpendicular to a substantially straight generating line of the window; second connecting means interposed between a second end of the transmission arm and said slide means; actuating means comprising an actuating arm connected to and rotating in relation to the slideway about a second axis; and third connecting means for connecting a point on said actuating arm in rotary manner to an intermediate point on the transmission arm; characterized by the fact that said first axis is skew in relation to said generating line.

According to a preferred embodiment of the window regulating device described above, the first axis forms an adjustable slope angle with said generating line; and adjusting and fastening means are preferably provided for locking the first axis in any skew position in relation to said generating line and within a given range of said slope angle.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
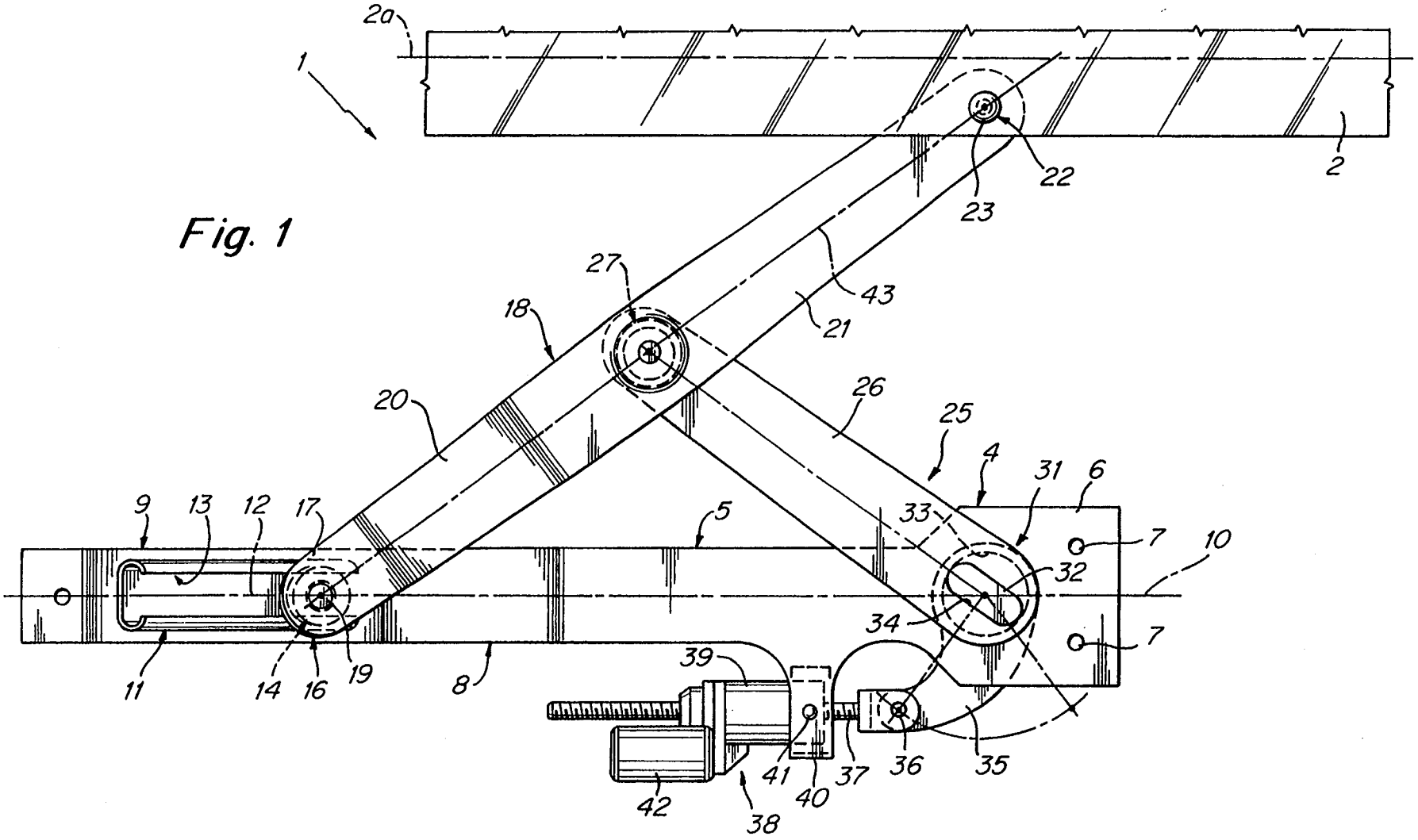
FIG. 1 shows a side view of a preferred embodiment of the device according to the present invention.
Figure 2:
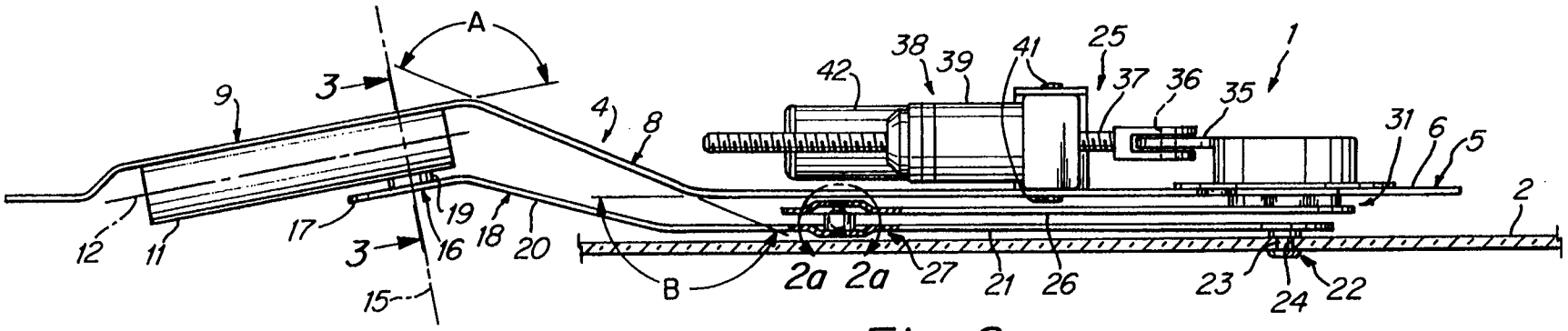
FIGS. 2 and 2*a* shows a bottom view of the device of FIG. 1.
Figure 2A:
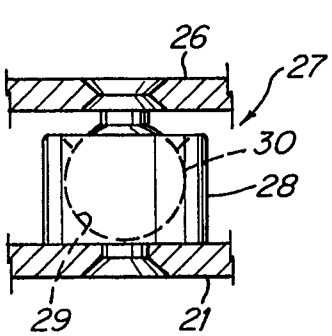
Figure 4B:
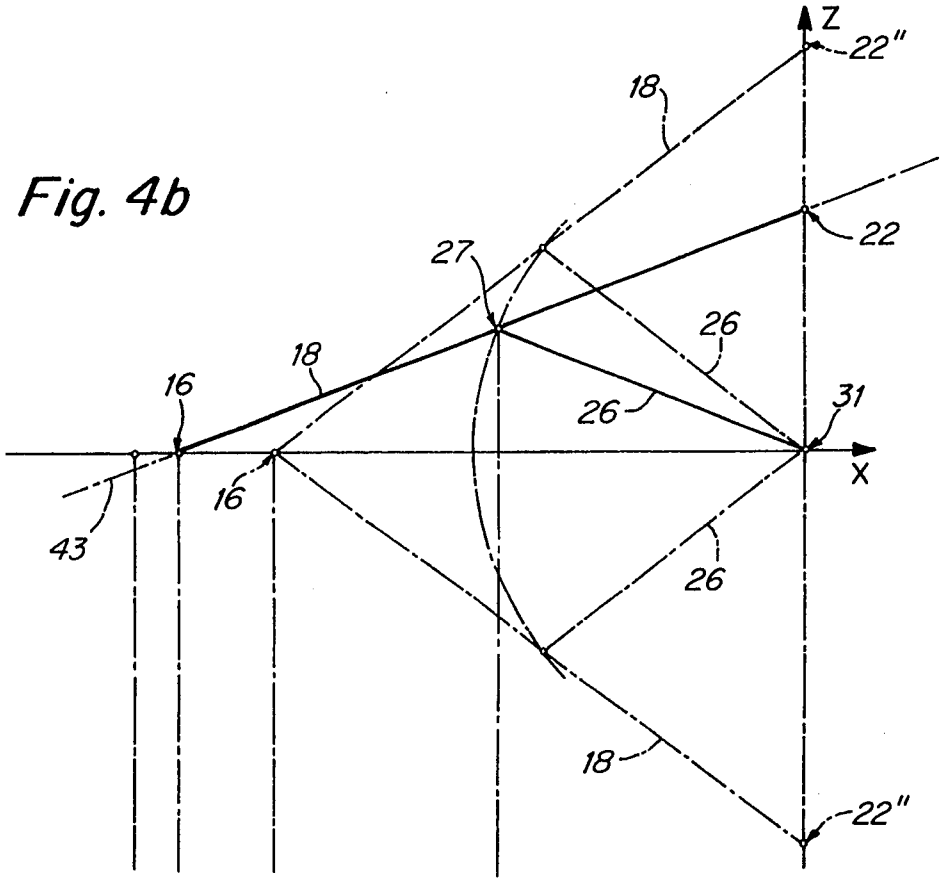
FIGS. 4*a*, 4*b* and 4*c* show three geometrical projections of the same operating diagram of the FIG. 1 device.
Figure 4C:
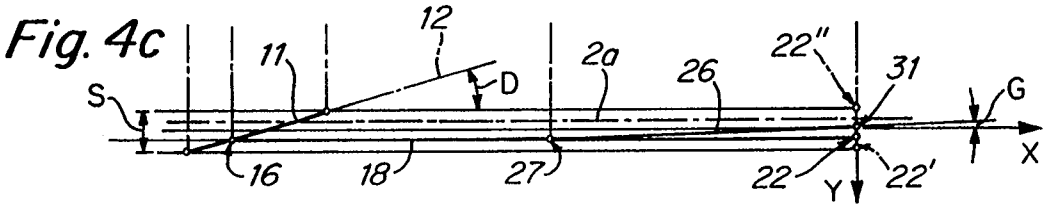
Figure 4A:
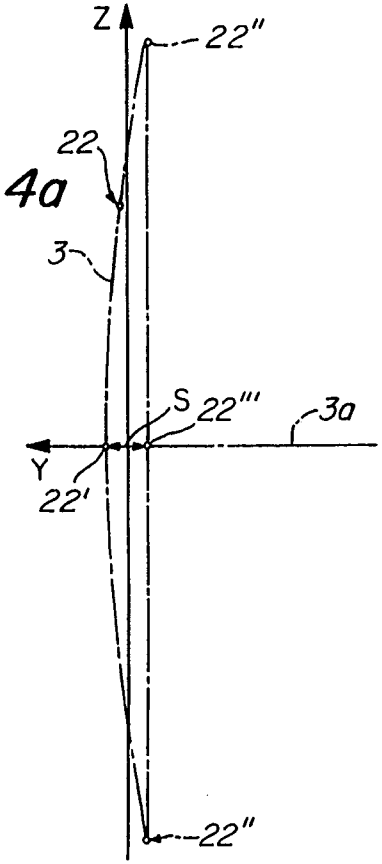

Number 1 in FIGS. 1 and 2 indicates a window regulating device designed for fitment to the structure of a door (not shown) of a vehicle (not shown), in particular a motor vehicle, for regulating the position of a curved window 2 along a arcuater path 3 (FIG. 4*a*) extending about a substantially horizontal axis 3*a* perpendicular to the FIG. 4*a* plane. Path 3 is defined by a pair of slideways (not shown) located laterally and on either side of window 2, and extending perpendicular to generating line 2*a* of window 2 and substantially parallel to the FIG. 4 plane.

Device 1 comprises an elongated bracket 4 consisting of a first portion 5 having, at one end, a plate 6 with two holes 7 for screws (not shown) for fitting bracket 4 to the vehicle door (not shown). Bracket 4 also comprises a second intermediate portion 8 and a third end portion 9, both aligned with first portion 5 along the longitudinal axis 10 of bracket 4.

Axis 10 consists of a broken line lying in a plane substantially parallel to generating line 2*a*; and portions 8 and 9 of bracket 4 form an obtuse angle "A", and portions 8 and 5 an obtuse angle "B" opposite angle "A" in relation to intermediate portion 8.

End portion 9 is fitted stably with a slideway 11 defined by a hollow, substantially cylindrical body having an axis 12 parallel to the portion of axis 10 extending along end portion 9, and skew in relation to generating line 2*a*.

Here and hereinafter, the term "skew" in connection with axis 12 is intended to mean that axis 12 forms an angle of other than zero with the projection of generating line 2*a* in a plane through axis 12 and parallel to generating line 2*a*.

Moreover, hereinafter, the angle marked "D" in FIG. 4*c* and formed by axis 12 and the projection of generating line 2*a* in said plane through axis 12 and parallel to generating line 2*a* will be referred to as the "slope angle" of axis 12 in relation to generating line 2*a*.

Figure 3:
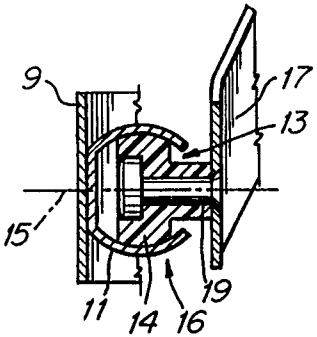
FIG. 3 shows a larger-scale section along line III—III in FIG. 2.

Slideway 11 presents a longitudinal opening 13 and is engaged by a slide 14 (FIG. 3) consisting of a toroidal washer fitted to slideway 11 so as to travel along axis 12 and rotate in relation to slideway 11 about an axis 15 substantially perpendicular to axis 12.

Together with slideway 11, slide 14 defines a spherical joint 16 for connecting slideway 11 to the end portion 17 of a transmission arm 18 to which slide 14 is connected by a pin 19 coaxial with axis 15 and extending outwards of slideway 11 through opening 13. Portion 17 of arm 18 lies substantially parallel to portion 9 of bracket 4, and is connected, by an inclined intermediate portion 20, to a further end portion 21 connected to the bottom end of window 2 via a spherical joint 22 defined by a pin 23 integral with arm 18 and loosely engaging a hole 24 formed in window 2.

Device 1 also comprises an actuating device 25 comprising a crank type actuating arm 26 interposed between portion 21 of arm 18 and portion 5 of bracket 4.

As shown, particularly in FIG. 2, arm 26 presents one end connected to arm 18 by a spherical joint 27 located centrally along arm 18 and which comprises a hollow body 28 integral with arm 18 and having, on the side facing arm 26, a spherical seat 29 for a spherical head 30 integral with arm 26.

The end of arm 26 opposite that fitted with spherical head 30 is connected to portion 5 of bracket 4 by an angle joint 31 separated from spherical joint 27 by a distance equal to that between spherical joint 27 and each of joints 16 and 22.

Joint 31 is defined by a substantially rectangular-section pin 32 engaging, in rotary manner, a circular hole 33 formed in bracket 4, and, loosely, a substantially rectangular hole 34 formed through arm 26.

Pin 32 presents an end portion projecting outwards of portion 5 of bracket 4 and connected in angularly integral manner to one end of a crank 35, the opposite end of which is hinged by a pin 36 to the output rod 37 of an actuator 38, the outer casing 39 of which is hinged to an appendix 40 on bracket 4 by a pin 41 parallel to pin 36. Rod 37 extends perpendicular to pins 36 and 41, and engages a nut screw (not shown) inside casing 39 and rotated about its axis by an electric motor 42 also integral with casing 39.

According to a variation not shown, arm 26 is connected in angularly integral manner to electric motor 42 by a known universal joint.

Operation of device 1 will now be described with reference to FIG. 4 in which device 1 is illustrated, with reference to a system of perpendicular axes X, Y, Z, in an intermediate position between two limit positions (shown by dot-and-dash lines ) each corresponding to a limit position of window 2 wherein joint 22 is set to position 22″.

As of the above intermediate position, operation of motor 42 rotates arm 26 in relation to bracket 4, so as to move joint 16 along axis 12 of slideway 11, and joint 22 between limit positions 22″ and possibly through an intermediate position 22′ to which joint 22 is set when arms 18 and 26 are aligned side by side.

As shown in FIG. 4*c*, by virtue of axis 12 presenting, in the X-Y plane, slope angle "D" in relation to the X axis and consequently in relation to generating line 2*a* substantially parallel to the X axis, arm 18, in addition to rotating in the X-Y plane, is also moved in the X-Y plane and maintained substantially parallel to the X axis by arm 26, which, being connected at one end to the center line of arm 18 by joint 27, and at the other end to bracket 4 by joint 31, rocks in the X-Y plane and forms a variable angle "G" with the X axis, which rocking action is made possible by virtue of pin 32 loosely engaging hole 34 formed in arm 26.

In other words, when arm 26 is rotated, joint 22 travels in known manner along axis Z and between positions 22″, and, at the same time, by virtue of slope angle "D" of axis 12, moves parallel to axis Y by a maximum distance S between position 22′ and a position 22‴ obtained by projecting position 22″ in the X-Y plane. The combination of the above two movements enables joint 22 to travel along a curved path 3 extending in the Y-Z plane and the curvature of which is proportional to distance S and consequently to angle "D", by virtue of distance S being equal to the length of slideway 11 multiplied by the sine of angle "D".

Also, as arm 26 is rotated in the X-Z plane and window 2 moves between said limit positions, arm 18 rotates about its longitudinal axis 43 through joints 16 and 22, so as to enable pin 23 of joint 22 to be maintained perpendicular at all times to the surface of window 2 as this travels along path 3.

Figure 5:
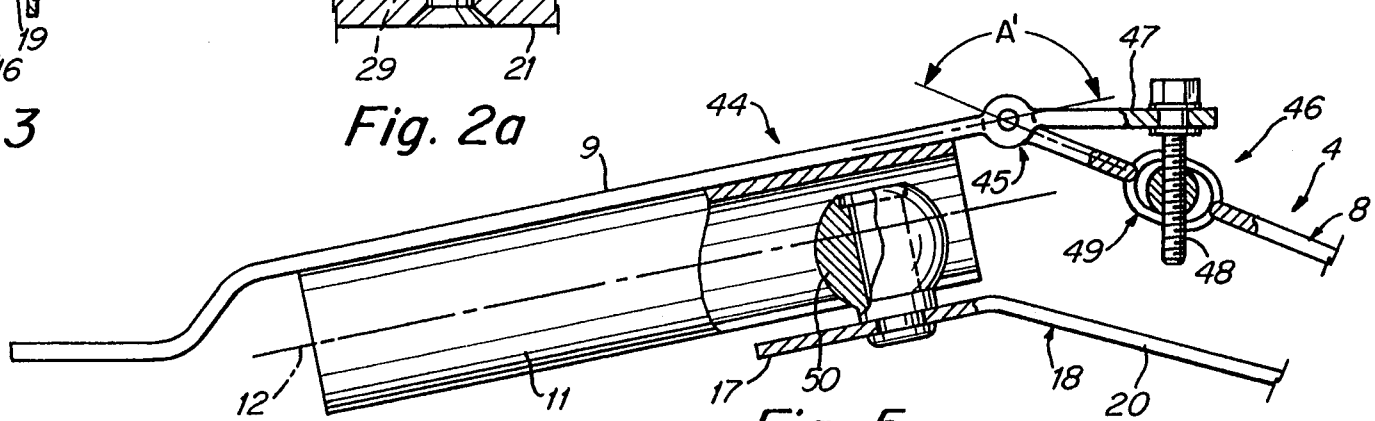
FIG. 5 shows a larger-scale, partial section of a variation of a detail in FIG. 2.

The aforementioned principle whereby a given slope angle "D" corresponds to a given curvature of path 3 is employed in the FIG. 5 variation for enabling fitment of device 1 to a door (not shown) of any curvature. The FIG. 5 variation in fact relates to a window regulating device 44, which only differs from device 1 by portion 9 of bracket 4 being connected to the end of intermediate portion 8 of bracket 4 by a cylindrical hinge 45 having its axis perpendicular to axis 10, so as to form, with portion 8, a variable angle A′ proportional to angle "D".

Device 44 also comprises a device 46 for adjusting the angular position of portion 9 about the axis of hinge 45. Device 46 comprises an appendix 47 projecting axially from portion 9 and beyond hinge 45; and a set screw 48 fitted through appendix 47 and connected to an olive connection 49 on portion 8.

To enable arm 18 to adapt to any angular position of slideway 11 within a given range of angle A′, which may even correspond to a zero value of angle "D", washer 14 of joint 16 on device 1 is replaced by a ball 50.

Device 44 may thus be adapted to any door by simply adjusting device 46 so that angle A′ and consequently angle "D" correspond to the curvature of the door in question.

According to a variation not shown, adjusting device 46 is dispensed with, and portion 9 of bracket 4 is left free to rotate about the axis of hinge 45 and so form, with portion 8, an angle A′ which may vary, together with angle "D", as a function of the curvature of the door for each position of window 2, thus enabling device 44 to be also fitted to doors of variable curvature in the sliding direction of window 2.

In the event adjusting device 46 is eliminated, it is advisable to elastically counteract rotation of portion 9 about the axis of hinge 45 by means of return springs not shown.

I claim:

1. A vehicle window regulating device comprising:

a slideway extending along a first axis and designed to fit integrally with a door;

a bracket rigidly coupled to the slideway;

slide means slidably coupled to the slideway for traveling along said first axis;

a transmission arm;

first connecting means for connecting a first end of the transmission arm to a curved window mounted to slide, relative to the door, along an arcuate path substantially perpendicular to a substantially straight generating line of the window;

second connecting means interposed between a second end of the transmission arm and said slide means;

actuating means having an actuating arm rotatably connected to the bracket rotating relative to the slideway about a second axis; and third connecting means for rotatably connecting said actuating arm to an intermediate position on the transmission arm, wherein said first axis is skew in relation to said generating line.

2. A device as claimed in claim 1, wherein the first axis forms a variable slope angle with said generating line.

3. A device as claimed in claim 2, further comprising means for adjusting and fixing said slope angle.

4. A device as claimed in claim 3, wherein said adjusting and fixing means locks the first axis in any skew position in relation to said generating line and within a given range of said slope angle.

5. A device as claimed in claim 1, wherein said third connecting means comprises a spherical joint.

6. A device as claimed in claim 1, wherein said second connecting means comprises a spherical joint.

7. A device as claimed in claim 6, wherein said slideway is a cylindrical slideway, and said slide is defined by a toroidal washer fitted in rotary and sliding manner to the slideway to define said second connecting means.

8. A device as claimed in claim 1, further comprising angle joint means interposed between said actuating arm and said bracket.

9. A device as claimed in claim 1, wherein the bracket has a first end portion and a second end portion parallel to said generating line and said first axis, respectively; said first portion supporting said actuating arm; and said second portion being integrally fitted with said slideway.

* * * * *

UNITED STATES PATENT AND TRADEMARK OFFICE

CERTIFICATE OF CORRECTION

PATENT NO. : 5,337,519
DATED : August 16, 1994
INVENTOR(S) : Giuseppe Bergesio

It is certified that error appears in the above-indentified patent and that said Letters Patent is hereby corrected as shown below:

On the title page, item,

[73] Assignee: Delete "Rivol, Israel" and insert -- Cascine Vica-Rivoli, Italy --.

Signed and Sealed this

Twenty-first Day of February, 1995

*Attest:*

Bruce Lehman

BRUCE LEHMAN

*Attesting Officer*

*Commissioner of Patents and Trademarks*